United States Patent [19]

Bagnall

[11] Patent Number: 4,834,005

[45] Date of Patent: May 30, 1989

[54] TUFTING MACHINE ADJUSTABLE STROKE MECHANISM

[75] Inventor: Arthur F. Bagnall, Manchester, England

[73] Assignee: Spencer Wright Industries, Inc., Dalton, Ga.

[21] Appl. No.: 234,907

[22] Filed: Aug. 22, 1988

[30] Foreign Application Priority Data

Sep. 8, 1987 [GB] United Kingdom ..... 8721071

[51] Int. Cl.[4] ..... D05C 15/20

[52] U.S. Cl. ..... 112/80.42

[58] Field of Search ..... 112/80.42

[56] References Cited

U.S. PATENT DOCUMENTS 3,748,914 7/1973 Parsons ..... 112/80.42 X 3,857,345 12/1974 Higgins ..... 112/80.42

4,515,096 5/1985 Ingram ..... 112/80.42

*Primary Examiner*—Ronald Feldbaum

*Attorney, Agent, or Firm*—Alan Ruderman

[57] ABSTRACT

A tufting machine has an adjustable needle stroke mechanism including an adjustable variable eccentric drive. The output of the drive is applied to a transversely extending oscillatable mainshaft by means of a fixed length rocker arm adjustably clamped to the mainshaft. The mainshaft is adapted to carry rocker arms at each push rod for reciprocating the push rods and thus the needles. The variable eccentric drive includes a circular cam eccentrically disposed between a pair of drive plates mounted on and rotatably driven by a cam shaft. The cam drives a connecting rod for driving the fixed length rocker arm. The cam is connected by bolts to the drive plates extending through holes in the cam and elongated slots in the drive plates. The eccentricity of the cam may be adjusted by moving the cam relative to the cam shaft and securing the bolts at different locations within the drive plate slots. An indicator disk is mounted on the cam shaft and has a plurality of holes at varying distances from the axis of the cam shaft and receives two of the bolts in selected holes to indicate the stroke selected.

8 Claims, 2 Drawing Sheets

TUFTING MACHINE ADJUSTABLE STROKE MECHANISM

BACKGROUND OF THE INVENTION

This invention relates to tufting machines, and more particularly to a tufting machine having an adjustable needle stroke mechanism for adjusting the stroke of all the push rods and thus the needles from each end of the machine.

Needle stroke adjusting mechanisms for tufting machines are of two general types. In one type, known as a "dial type" adjustment of the stroke of the tufting machine is made by changing the point of attachment of an input drive to a rocker arm through which an oscillatory motion from an eccentric cam mounted on a rotating shaft is applied to a rocker type or oscillating main shaft, the needles being reciprocably driven by push rods connected to respective rocker arms clamped above the push rods to the main shaft. Mechanisms of this type are well known in the art, examples being illustrated in U.S. Pat. Nos. 2,977,905 and 3,881,432. In the other type of needle stroke adjusting mechanism the connecting rod of an eccentric or crank arrangement is mounted directly to each push rod, the eccentric or other arrangement being mounted on a rotating main shaft. Again, mechanism of this type are now well known in the art, and examples are illustrated in U.S. Pat. Nos. 3,839,972; 3,857,345 and 4,515,096.

In tufting machines having the latter type adjusting mechanisms, since there is an adjusting mechanism at each push rod, and in most full size tufting machines (12 to 15 feet) there may anywhere from 8 to 12 push rods, the substantially greater number of parts creates a more expensive tufting machine and thus these mechanisms are generally used only for specialized and very high speed machines. However, the main disadvantage of these mechanisms is that each time a needle stroke adjustment is required to be made, since the adjustments must be made at each push rod which is internal of the tufting machine head, the head of the machine must be opened and all the mechanisms must be substantially disassembled for such changes to be performed. This procedure is extremely time consuming and results in large machine down-time.

In "dial type" adjusting mechanism tufting machines, needle stroke changes need be performed only at each end of the machine by moving the point of attachment from the input drive to the rocker arm, the rocker arm having an arcuate slot with a center of curvature coinciding with the geometric center of the eccentric cam when the cam is at bottom dead center. Since there are only two such mechanisms and since there is no need to enter the interior of the machine head and tear down substantial portions thereof, the amount of time consumed when making a needle stroke change in such machines is substantially less than with the non-dial type machine. Thus, dial type machines are widely used in those tufting machines which are not in the very high speed range.

However, dial type machines do have inherent disadvantages. Firstly, the connection between the drive input and the rocker arm must be such that it will satisfactorily transmit a drive to the rocker shaft without slippage of the connection yet lend itself to adjustment between a range of separate and distinct positions. A second problem concerns the nonuniform nature of the forces applied to the needle mechanism arising from the change in leverage of the slotted rocker arm upon adjustment. A third problem is that the slotted rocker arm is inherently structurally weak and intolerant of the forces transmitted by high speed tufting machines. A still further disadvantage of such structures is the possible need for compensatory adjustment of other tuft-forming instrumentalities of the tufting machine on needle stroke adjustment as of the bottom dead center position of the needle in like circumstances.

SUMMARY OF THE INVENTION

Consequently, it is a primary object of the present invention to provide a needle stroke mechanism for a tufting machine for adjusting the needle stroke at each end of the machine, the machine lending itself to the ready adjustment of the needle stroke while avoiding the difficulties inherent in conventional "dial type" mechanisms.

It is another object of the present invention to provide a tufting machine having a needle stroke adjustment mechanism for adjusting the push rods and thus the needle stroke from the ends of the machines, the mechanism coupling and adjustable variable eccentric to a main rocker shaft extending the length of the machine, the coupling being by means of a fixed length rocker arm.

Accordingly, the present invention provides a tufting machine having an adjustable needle stroke mechanism, the mechanism including an adjustable variable eccentric drive, the output of the drive being applied to a transversely extending rocker shaft by means of a fixed length rocker arm adjustably clamped to the rocker shaft, the rocker shaft being adapted for carrying a rocker arm at each push rod for effecting reciprocatory motion of the push rods and thus the needles of the machine.

According to a preferred feature of the invention, the variable eccentric drive includes an annular eccentric cam disposed between spaced parallel drive plates mounted on and rotatable with an input shaft, the eccentric cam being adjustable radially relatively the drive plates and being connected thereto by bolts engaging through holes in the eccentric cam and aligned elongated slots in the drive plates, the eccentric cam having an elongated slot through which the input shaft extends.

According to a further preferred feature of the invention the needle stroke adjusting the mechanism includes an indicator plate arranged coaxially with the drive plates, the indicator plate including a plurality of through holes therein arranged in spaced disposition relative to the input shaft, at least some of the holes being at different respective distances from the axis of the input shaft and being of a size adapted to receive at least certain of the bolts according to the relative positions of the drive plates and the eccentric.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
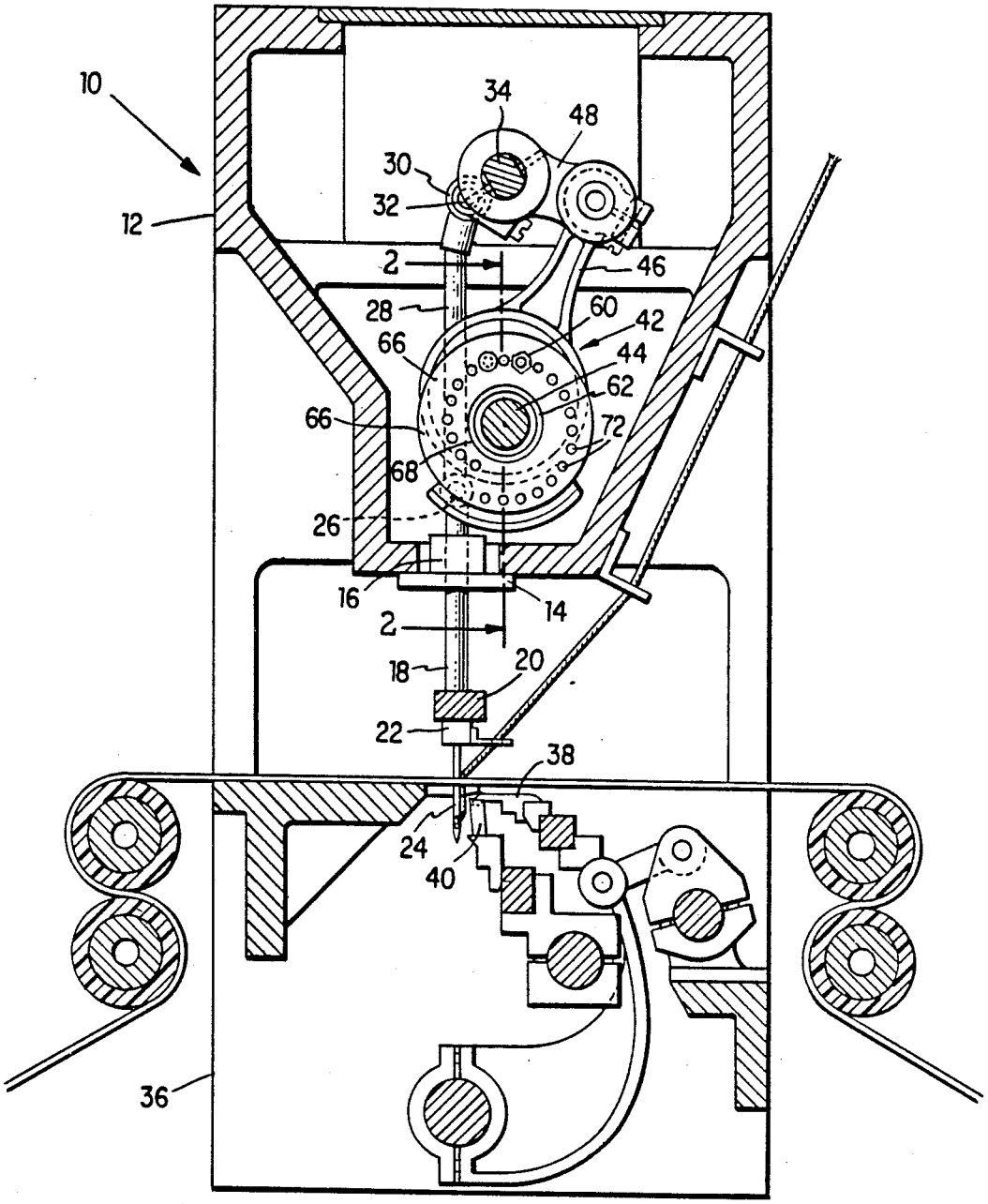
FIG. 1 is a vertical sectional view adjacent one end of a tufting machine incorporating adjustable needle stroke drive mechanism constructed in accordance with the principles of the present invention.

Referring now to the drawings, and more particularly to FIG. 1, the pertinent portions of a tufting machine 10 required for a description of the present invention is disclosed, the machine comprising a head 12 within which is secured a plurality of collars 14, only one of which is illustrated for supporting respective sleeves 16. Journally disposed for reciprocation within each sleeve is a push rod 18. Attached to the lower end of the push rods 18 is a needle bar carrier 20 which in turn supports a needle bar 22 extending transversely of the machine and which carries a multiplicity of downwardly depending needles 24. The upper end of each push rod 18 is connected to a wrist pin or the like 26 to a link 28 which is in turn connected by another wrist pin 30 to a rocker arm 32 which in turn is clamped to an oscillating main shaft 34 so that rocking motion applied to the shaft 34 results in reciprocation of the needle bar 18 and thus the needles 24. Mounted in the bed 36 of the tufting machine and driven in timed relationship with the reciprocation of the needles is a plurality of hooks or loopers 38 corresponding in number to the number of needles 24 for seizing loops of yarn from the needles. A knife 40 may cooperate with each respective hook 38 for cutting the loops of yarn seized thereby. All of the mechanism heretofore described is notoriously well known to those skilled in the tufting art and further description of the details thereof are not deemed necessary.

Conventionally, in "dial type" tufting machine a slotted rocker arm is clamped to the main shaft 34, the rocker arm having a slot within which a connecting rod from an eccentric strap mounted on an eccentric cam fastened to an input or cam shaft is adjustably connected. As the cam shaft rotates the motion of the eccentric cam is transmitted to the slotted rocker arm and thus to the main shaft to oscillate the same. Adjustment of the needle stroke may be effected by positioning the connecting rod within the slot. However, and in particularly higher speed tufting machines, the connection between the connecting rod and the slotted rocker arm may loosen, and additionally difficulties arise from the inherent weakness of the slotted arm structure. The present invention while maintaining the advantages of "dial type" adjusting mechanisms, i.e., adjustments being made from the transverse ends of the machine only and not at each push rod, overcomes the aforesaid drawbacks of the known "dial type" machines by providing an eccentric drive generally indicated at 42 which is mounted on the input cam shaft 44. The connecting rod 46 of the eccentric drive is pivotally connected to one end of a fixed length rocker arm 48, the other end of which is secured by clamping to the main shaft 34 at predetermined angular positions thereon.

In accordance with the present invention the eccentric drive 42 is such that the throw provided thereby is adjustable, the connecting rod 46 of the eccentric drive being pivotally secured to the rocker arm 48 at a fixed position thereon. The angular disposition of the rocker arm 48 on the rocker shaft 34 is, however, adjustable according to the adjustment of the eccentric drive so that although the needle stroke may be adjusted, the bottom dead center position for the reciprocating motion of the needles 24 may be maintained at the predetermined disposition for cooperation with the hooks 38.

The eccentric drive 42 comprises a circular cam 50 eccentrically disposed on the input shaft 44 located between a pair of coaxial drive plates 52, 54 mounted on the shaft 44, the cam being radially adjustable relative to the rotational axis of the drive plates to adjust the throw of the eccentric drive. Thus, the cam 50, defined as an eccentric or eccentric cam, includes an elongated slot 56 extending radially therein, the slot 56 being enlarged in the elongated direction relative to the diameter of the shaft 44, the eccentric cam 50 further including a multiplicity of through holes 58 for receiving two or more mounting bolts 60, 61. The drive plates 52, 54 are of an annular form, and each has an integral axially directed flange or hub 62 coaxially disposed about the inner periphery of the respective drive plate for receiving the shaft 44, the hubs being keyed to the shaft 44 and rotatably driven thereby. A multiplicity of spaced elongated slots 64 is provided in each of the drive plates 52, 54, the slots 64 being registrable with the through holes 58 in the eccentric cam 50 and being directed so as to maintain such registration upon movement of the eccentric cam 50 relative to the drive plates 52, 54 in the direction of elongation of the slot 56 in the eccentric cam.

It should be appreciated that by passing the mounting bolts 60, 61 through the aligned slots 64 in the drive plates 52, 54, and the through holes 58 in the eccentric cam 50, and tightening the bolts, the plates 52, 54 and the eccentric 50 can be secured together. The throw of the eccentric drive 42 is determined by the relative positions of the plates 52, 54 and the eccentric cam 50 in the elongated direction of the slot 56 in the eccentric cam. An adjustment of the throw can be effected simply by loosening the bolts 60, 61, moving the eccentric cam 50 to a new position radially of the drive plates 52, 54, and retightening bolts 60, 61 at that new position.

Figure 2:
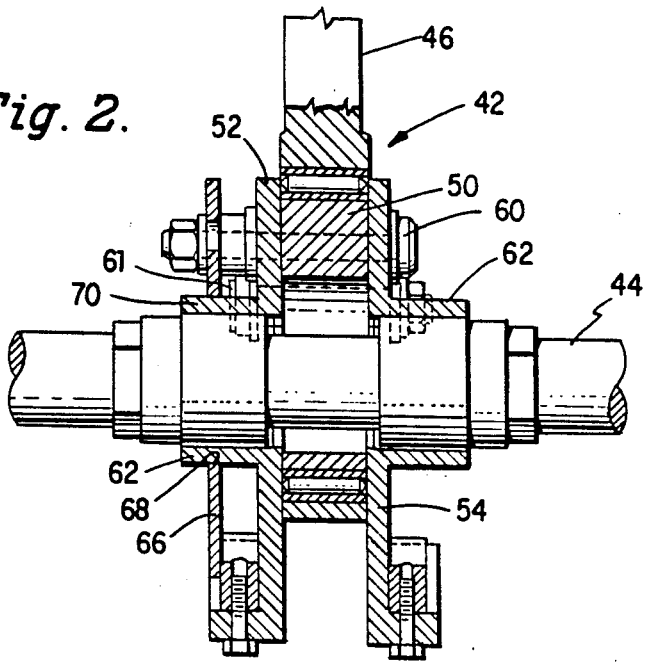
FIG. 2 is a fragmentary cross sectional view taken substantially along line 2—2 of FIG. 1.
Figure 3:
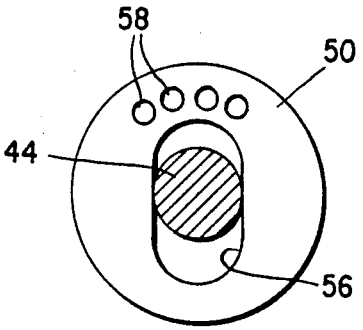
FIG. 3 is a diagrammatic view of the eccentric cam in relation to the input shaft.
Figure 4:
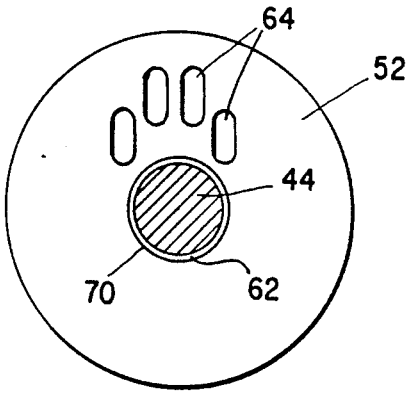
FIG. 4 is a view similar to FIG. 3 showing one of the drive plates.

In order to provide for accurate reproduction of a given throw, and thus of a given needle stroke, a control or indicator disk 66 may be embodied in the eccentric drive. The indicator disk 66 preferably is of an annular form and has a central aperture 68 therein free from but closely fitted about the outer periphery 70 of the hub 62 of one of the drive plates, e.g., the plate facing externally of the end of the tufting machine. A multiplicity of through holes 72 is provided in the control or indicator disk, the holes 72 being at predetermined centers one from another about the face of the disk with successive holes being at progressively greater distances from the center of the disk so that the holes provide an array having a spiral form. The holes 72 are of such a diameter as to be adapted to receive the bolts 60, which are longer than the bolts 61, and the centers of the holes are such that any two holes 72 are registrable with two of the holes 58 and elongated slots 64 in the eccentric cam and drive plates 52, 54 respectively. Preferably the two holes are two alternate holes for ease of alignment with the holes and slots in the cams 50 and plates 52, 54 respectively, and yet without unnecessarily limiting the number of stroke adjustments and without effecting interference of the bolts if adjacent holes 72 were utilized. Thus, having regard to the proper location of the control or indicator disk 66 relative to the fixed rotational axis of the input shaft 44, the position of the eccentric cam 50 relative to that axis can be identified by reference to the through holes 72 in the disk 66 which align with the bolts 60 of the assembled eccentric drive, the holes 72 preferably having numbers or other reference indicia which correlate to the needle stroke and the hole between the two alternate holes may be readily used in a table correlating to the stroke. As can be seen in reference to FIG. 2, in practice, the bolts 60 extend through the holes 72 in the control disk 66, and adjustment of the eccentric drive is effected simply by retracting the bolts 60 by an amount sufficient to disengage them from the holes 72, rotating the disk 66 such that the holes 72 corresponding to the required throw assume a position for receiving the two bolts 60, and thereafter raising or lowering the eccentric cam 50 to bring the bolts 60 into alignment with the relevant holes 72. The bolts are then reengaged in the holes 72 in the disk and retightened. The clamping together of the cam 50 and the plates 52, 54 are effected by these two bolts and by bolt 61 which do not extend through the the indicator plate 66.

Adjustment of the throw of the eccentric cam 50 will effect a corresponding adjustment in the extent of the oscillatory motion of the rocker arm 48 and the angular movement of the rocker shaft 34. However, it is necessary to ensure that the extreme angular position of the rocker shaft 34 corresponding to the bottom dead center position of the needles remains constant independently of the throw of the eccentric cam so as to maintain the required operational relationship between the needles 24 and the hooks 38 of the tufting machine. The maintaining of this bottom dead center position is effected by adjusting the eccentric cam while the drive is at the bottom dead center position of the needles after having first loosened the rocker arm 48 from its clamped position on the rocker shaft 34, the connection being again secured upon completion of the adjustment. If desired, an appropriate vernier scale may be provided between the rocker arm 48 and the rocker shaft 34 to give a quantitative value of the angular relationship existing therebetween for comparison with the corresponding reading of the setting at the other end of the tufting machine so as to ensure consistent adjustment at both ends.

It should be clear that while in the preferred embodiment, the bolts securing the eccentric drive in an adjusted condition extend through the control or indicator disk 66, it is sufficient merely that some datum be provided if ready reproducability of a setting is to be available. In the absence of a control or indicator disk, or the equivalent, the eccentric drive herein still enables ready adjustment of the needle stroke without introducing material changes in the loading applied to the various elements and without inducing the potential for slippage of a connection between a fixed throw eccentric cam connecting rod and a slotted rocker arm. However, the inclusion of the indicator disk 66 does provide the read reproducability of a given needle stroke and thereby provide the advantages of a "dial type" tufting machine.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufting machine having a frame, a mainshaft extending transversely in said frame, a multiplicity of needles, means for constraining said needles for movement in a reciprocatory path, means including a plurality of levers for drivingly connecting said needles to said mainshaft for imparting reciprocatory movement to said needles, means for oscillating said mainshaft for oscillating said levers to reciprocate said needles between spaced points defining a stroke, and means for adjusting the stroke of said needles, said means for oscillating said mainshaft comprising a cam shaft spaced from and parallel to said mainshaft, a circular cam disposed eccentrically on said cam shaft, a rocker arm adjustably clamped on and extending from said mainshaft adjacent ends thereof, a connecting rod having a circular opening at one end for journally receiving said cam and pivotably connected at another end to said rocker arm at a location spaced from said mainshaft, said means for adjusting the stroke of the needles comprising an elongated opening in said cam for receiving said cam shaft and for movement relative to said cam shaft to change the eccentricity of said cam, at least one drive plate disposed adjacent a face of said cam fastened to said cam shaft, said drive plate having a plurality of parallel elongated slots, a plurality of through holes in said cam registrable with said slots, and a plurality of bolts positionable through said holes and said slots for securing said cam to said plate with said cam at selected eccentricities relative to said cam shaft.

2. A tufting machine as recited in claim 1, including an indicator disk mounted on said cam shaft, said indicator disk having a multiplicity of through holes at varying distances relative to the axis of said cam shaft, said holes being of a size adapted for receiving at least two of said bolts, said two bolts being received within a pair of selected holes in said disk corresponding to a selected needle stroke.

3. A tufting machine as recited in claim 2, wherein said through holes in said indicator disk form a spiral array relative to said cam shaft.

4. A tufting machine as recited in claim 3, wherein said two bolts are received within alternate holes in said array.

5. A tufting machine as recited in claim 1, wherein two drive plates are respectively disposed at opposite faces of said cam fastened to said cam shaft, the slots in one plate being aligned with the slots in the other plate.

6. A tufting machine as recited in claim 5, including an indicator disk mounted on said cam shaft, said indicator disk having a multiplicity of through holes at varying distances relative to the axis of said cam shaft, said holes being of a size adapted for receiving at least two of said bolts, said two bolts being received within a pair of selected holes in said disk corresponding to a selected needle stroke.

7. A tufting machine as recited in claim 6, wherein said through holes in said indicator disk form a spiral array relative to said cam shaft.

8. A tufting machine as recited in claim 7, wherein said two bolts are received within alternate holes in said array.

* * * * *